United States Patent [19]

Birkin

[11] Patent Number: 4,932,614

[45] Date of Patent: Jun. 12, 1990

[54] TRAIN COMMUNICATION SYSTEM

[75] Inventor: Michael S. Birkin, Attenborough, England

[73] Assignee: British Railways Board, England

[21] Appl. No.: 59,128

[22] Filed: Jun. 8, 1987

[30] Foreign Application Priority Data

Jun. 13, 1986 [GB] United Kingdom ..... 8614393

[51] Int. Cl.[5] ..... B61L 3/02

[52] U.S. Cl. ..... 246/34 R; 246/187 B; 246/34 C

[58] Field of Search ..... 246/187 B, 121, 120, 246/34 R, 34 C, 34 CT, 169 R; 342/50; 340/505, 652

[56] References Cited

U.S. PATENT DOCUMENTS 3,246,141 4/1966 Ehrlick ..... 246/121
3,805,056 4/1974 Birkin ..... 246/187 B
4,075,632 2/1978 Baldwin ..... 342/50

FOREIGN PATENT DOCUMENTS 1316561 5/1973 United Kingdom .
1375173 11/1974 United Kingdom .
1390225 4/1975 United Kingdom .
1469510 4/1977 United Kingdom .

*Primary Examiner*—Alvin Oberley
*Attorney, Agent, or Firm*—Davis, Bujold & Streck

[57] ABSTRACT

A communication system for a railway train has a proving circuit for proving conditions of the railway track ahead of the train. The proving circuit comprises a transponder associated with at least one rail of the track to form a rail circuit therewith. The response of the transponder to an interrogater on the train is dependent upon the condition of the rail circuit.

11 Claims, 4 Drawing Sheets

TRAIN COMMUNICATION SYSTEM

This invention relates to train communication systems.

There have been recent developments and proposals which radically alter the nature of railway signaling by the replacement of trackside signals and track circuit detection of train presence with radio based cab signaling systems and transponder based train position detection systems. This has enabled the Signal Engineer to consider eliminating costly track circuits, track cables and line side signals. One drawback would, however, be that the facility provided by track circuits for the detection of broken rails would no longer be available. Also removal of trackside cables would create the problem of indicating back to the control center and hence to the train that the switches (i.e. points) on the train's route have been proved. The object of this invention is to provide a means to overcome these drawbacks and problems.

According to the invention there is provided a communication system for a railway train and having a proving circuit for proving conditions of the railway track ahead of the train said proving circuit comprising a transponder associated with at least one rail of the track to form a rail circuit therewith, the arrangement being such that the manner in which the transponder responds to interrogator on the train is dependent upon the condition of said rail circuit.

Said transponder may be associated with both rails of the track and the rail circuit completed by a low resistance connection between the rails.

It can be arranged that said transponder may only respond to the interrogator if the rail circuit is in a predetermined condition indicating that the track ahead is complete, i.e. a rail is not broken. Alternatively it may respond in two or more different ways depending upon the actual condition of the rail circuit. Further it can be arranged that the rail circuit proves the switches (i.e. points) on the train route. The rail circuit may also be used to prove other features such as the closure of barriers at a crossing. A further application is the control of track features such as switches, barriers and warning indicators and the proving of the execution of that control.

Figure 1:
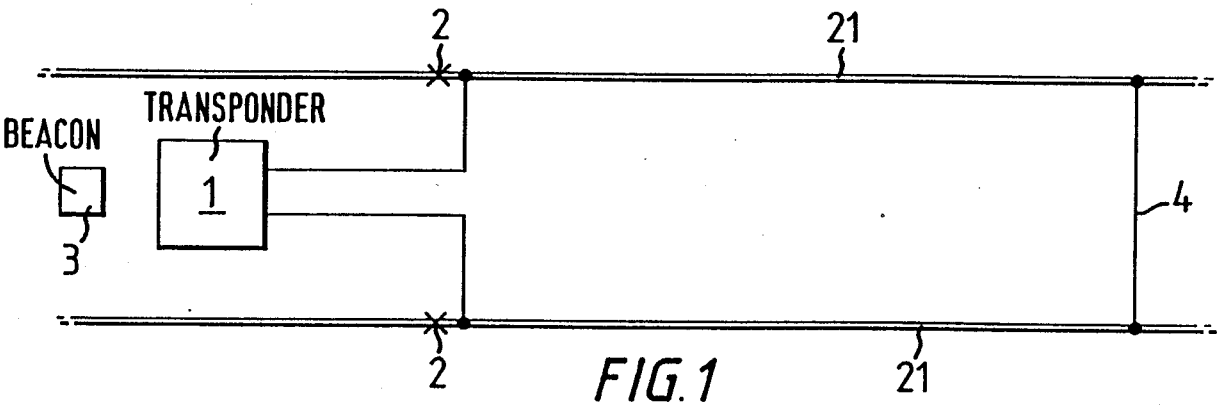
Figure 2:
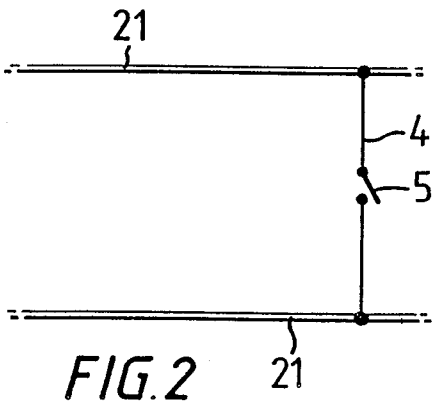
Figure 3:
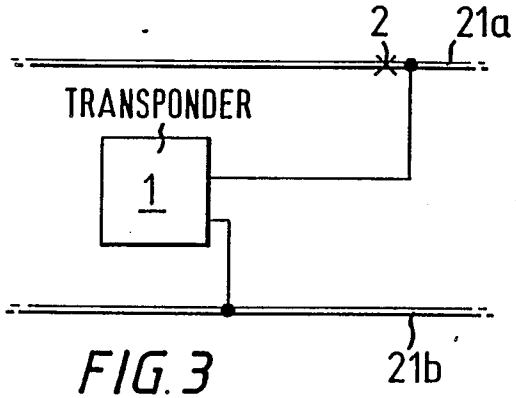
Figure 4:
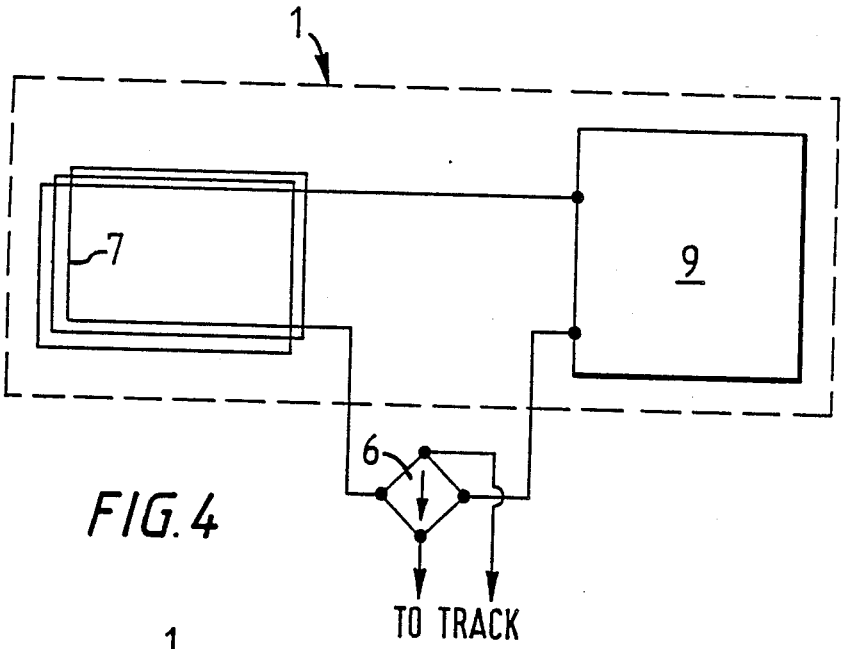
Figure 5:
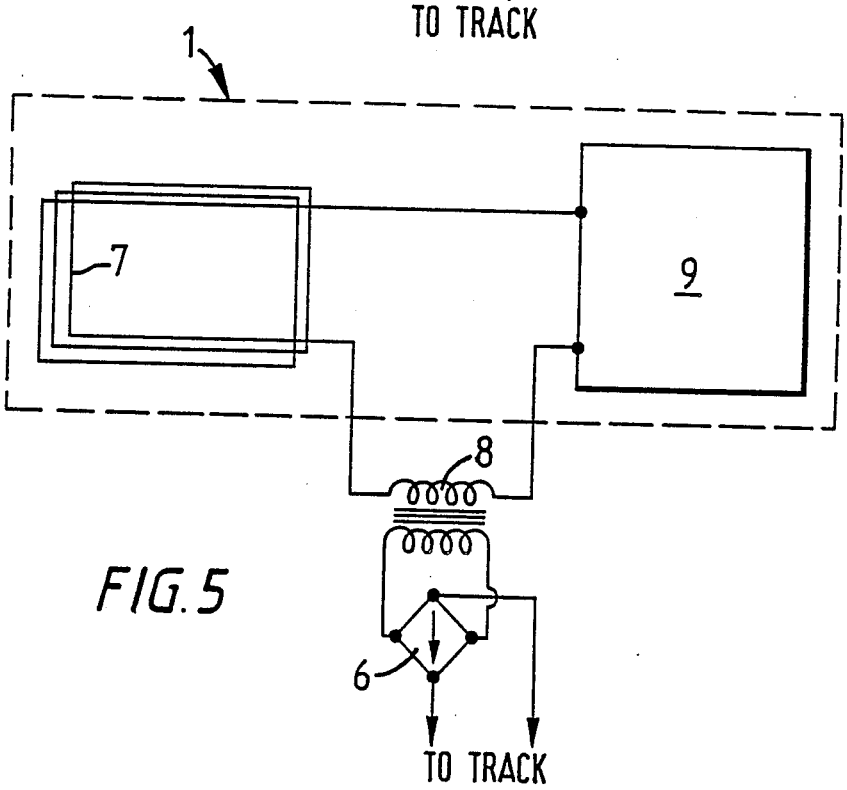
Figure 6:
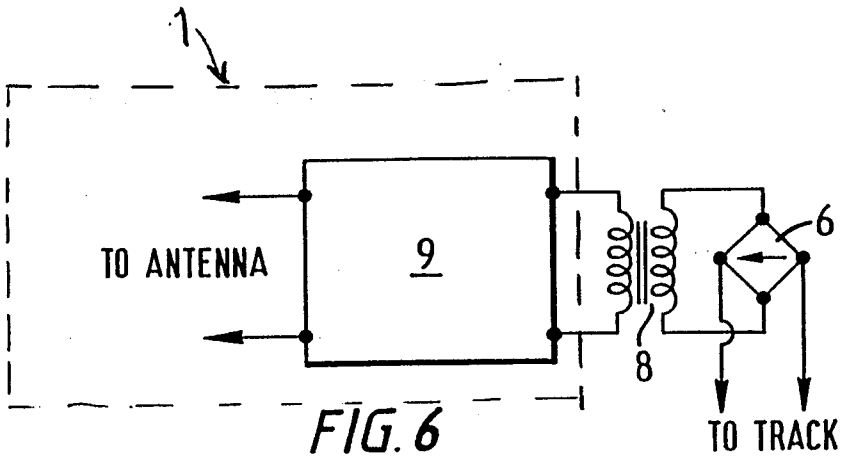
Figure 7:
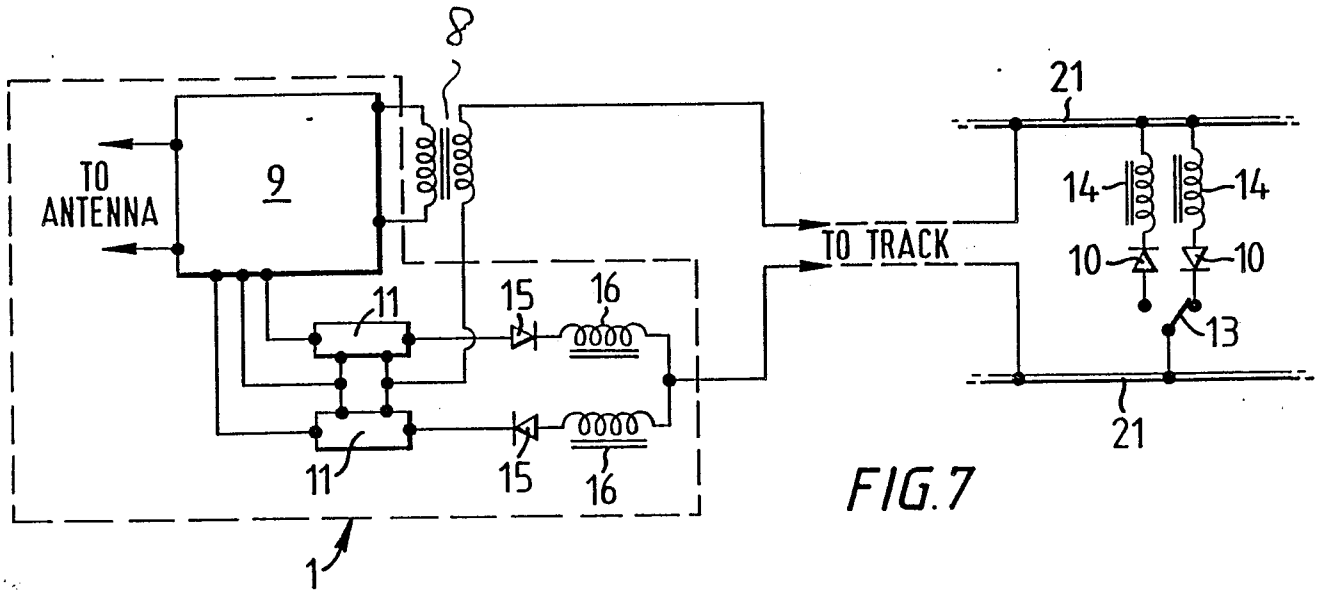
Figure 8:
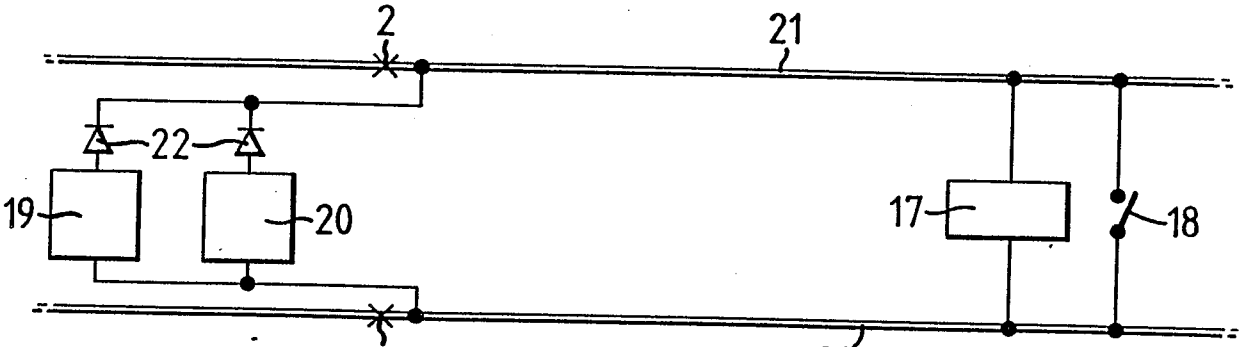
Figure 9:
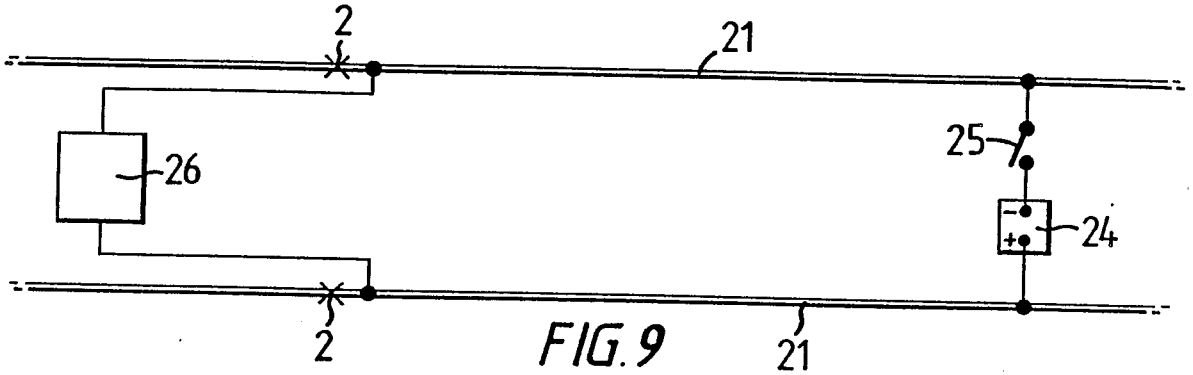

The invention will now be further described by way of example with reference to the accompanying drawings in which:

FIG. 1 shows the general connection of a transponder to the track to form a rail circuit in accordance with one embodiment of the invention, FIG. 2 shows a modification of the circuit of FIG. 1, FIG. 3 shows a further modification of the circuit of FIG. 1, FIG. 4 shows in more detail than FIG. 1 the manner of connection of the transponder to the rails, FIG. 5 shows an alternative circuit to FIG. 4, FIG. 6 shows a further alternative circuit to FIG. 4, FIG. 7 shows another embodiment of the invention, FIG. 8 shows a further embodiment of the invention, and FIG. 9, shows a still further modification of the circuit of FIGS. 1 and 2.

Throughout the drawings the same reference numerals have been used to designate corresponding parts.

Referring to the drawings, FIG. 1 shows the general connection of the transponder 1 to the rails 21 of a trackway to form a rail circuit which is completed by a short circuit connection 4, i.e. a low resistance connection, between the rails 21.

A transponder system working by means of power coupled to a transponder from an interrogator system on a train is well known to those skilled in the art. The present invention as exemplified in the embodiment of FIG. 1 differs from this in that the power circuit of the transponder 1 is only completed by means of the rail circuit through the rails 21 and short circuit 4.

The transponder 1 is positioned in advance of the track section to be proved so that it is interrogated by the train prior to the train entering that section. Hence the shunting effect of the axles of the train carrying the interrogator do not disturb the track section to be proved. One or more insulated joints 2 are provided to isolate the track section being proved from adjacent track sections. In this embodiment the vehicle on the track will only receive a satisfactory signal back via its interrogator if the rail circuit is complete i.e. closed. A broken rail will open the rail circuit.

The short circuit connection 4 may include a contact 5 (FIG. 2) for example a relay contact for proving other track features. Thus depending upon the condition of one or more other track features such as switches or barriers the contact 5 will be either open or closed to set the rail circuit either open or closed.

FIG. 3 shows that if the layout is such that it is possible to use only one insulating joint 2 to indicate one end of a rail section a simplification of the cable layout may be achieved. In FIG. 3 all the insulating joints 2 are provided in one rail 21*a* to define the rail sections and the other rail 21*b* may be continuous.

The position of the transponder 1 may be predicted by the train by the use of an odometer on the train or by a beacon 3 (as shown in FIG. 1) such as a permanent magnet or another transponder placed on the track in advance of the transponder 1. Hence if the train does not receive the expected message from transponder 1, the assumption made by the interrogator in the train is that the rail circuit is open.

To achieve the maximum length possible for a rail circuit, since it is in the form of a transmission line with parameters dependent on the rail resistance, inductance, leakage and capacitance it is preferable to use direct current energization of the rail circuit. However, it is possible that for some applications where it is possible to have short sections with resonate isolation that alternating current energization of the rail circuit could be of advantage.

FIG. 4 shows a means of connection of the transponder 1 into the rail circuit to provide D.C. energization of the rail circuit. The transponder 1 comprises electronics 9 and antenna 7. Rectifier bridge 6 is used to provide the D.C. energizing current from the alternating current which will be induced into the transponder antenna 7 from the interrogation equipment of the passing train. If the rail circuit is open, the rectifier 6 represents a high impedance which effectively isolates the transponder from its antenna so that no message is passed to the train.

FIG. 5 shows how the transponder 1 may be isolated from the rails 21 by means of a transformer 8. Again if the rail circuit is open, the transformer 8 represents a high impedance.

FIG. 6 shows an alternative circuit to FIGS. 4 and 5 and in which the reflection of the impedance of the rail circuit back to transponder 1 is used to control the message returned to the interrogator on the train. This contrasts with the circuit in FIG. 4 in which the high impedance is effectively used to isolate the transponder from its antenna. By impedance in the D.C. case is meant resistance. A high impedance as in the case of FIG. 5 indicates that the rail circuit is open-circuited by either a broken rail or a track feature such as a switch or relay contact not being made. The transponder could then be internally controlled either to give no response to the interrogator or be so arranged as to give a message indicating high impedance. For example the messages for high and low impedance could be different frequencies. If the detected impedance is within the accepted level for the track configuration then a message is returned by the transponder indicating that the track is safe to traverse.

FIG. 7 shows an embodiment of the invention in which the rail circuit is energized from an alternating voltage via the transformer 8. The rectifier 6 of FIGS. 4 to 6 is omitted and diodes 10 are oppositely connected in parallel in the short circuit connection between the rails 21. The condition of the track feature being proved is represented by the position of change-over contact 13. Each of the diodes 10 is connected in series with a high inductive reactance 14.

In operation one or other of the diodes 10 will be conducting depending upon the position of change-over contact 13. Thus switching of contact 13 will provide a change of polarity in the rail circuit. The prevailing polarity in the rail circuit thus indicates the condition of the track circuit being proved. A third option would be to prevent either of the diode circuits becoming energized by, for example, having an open circuit contact position on switch 13. The fail safe aspect of the diodes 10 is ensured in that if either of the diodes 10 fail causing a short circuit across it, the resulting alternating current will face a high reactance from the inductors 14 in the diode circuits 10 thus preventing sufficient current from flowing to operate the transponder 1 and preventing it showing a safe condition.

The diode circuits of FIG. 7 connect to the transponder 1. In this embodiment the transponder 1 incorporates diode rectifiers 15 with series connected high inductive reactance 16 to provide fail safe diode circuits. These rectifiers 15 connect with current detectors 11. Depending on either the polarity or the level of the current returned to the transponder current detectors 11, the transponder 1 is switched either to give various messages or the lack of message back to the vehicle interrogator so indicating the condition of the track features ahead as represented by the position of change-over contact 13 and/or the condition of the rails 21.

FIG. 8 shows an arrangement of two transponders connected to the track to form part of a rail circuit with which it is possible to control via that rail circuit a track feature in advance of the vehicle and prove that the control has been achieved. The vehicle first encounters and energizes transponder 19. The energization of this transponder is detected by a D.C. voltage means 17 connected to the track at the far end of the rail circuit. The output of this means 17 is used to initiate the operation of the track feature in question, such as the closing of a barrier or the operation of switchwork. The satisfactory operation of the said track feature then closes contact 18 and short circuits the track at that end. The closure of this contact 18 is then sensed by transponder 20 when that transponder is subsequently interrogated by the vehicle. If the control sequence has been satisfactorily completed then that transponder 20 will respond to the vehicle to indicate to the vehicle that the operation required has been completed in a satisfactory manner. Diodes 22 represent the diode bridges 6 shown in FIGS. 4 and 5. The existence of these bridges provides isolation between the two transponders 19 and 20. The track feature may be subsequently released by a similar arrangement of transponders or by other means, e.g. a treadle switch.

In FIG. 9 is shown a further modification of the rail circuits of FIGS. 1 and 2, in the case where there is so much line loss due to the trackway resistance and leakage that operation of the system becomes difficult. The performance of such a system can be improved if a direct current electrical power source 24 of the appropriate polarity is used to enhance the flow of current from the transponder 26 by inserting the power source in series with the short circuit or relay contact 25. Alternatively if the polarity of the electrical power source is reversed to oppose the flow of current then this may be used as a means of either switching off the transponder 26 or changing its message in order to avoid mal-operation of the rail circuit.

I claim:

1. A proving circuit, for a section of railway track, comprising an electrical rail circuit whose impedance is used as an indicator of track condition and including the rails of the track in the section;

a low resistance connection between the rails at one end of the section;

a passive transponder, including an antenna, connected with the rails at the other end of the section;

an interrogator on a train moving along the railway track for energizing the rail circuit and interrogating the transponder through said antenna;

and means in the rail circuit for controlling a response of the transponder to the interrogator, via said antenna, in dependence upon the impedance of the rail circuit.

2. A proving circuit according to claim 1, wherein the transponder is physically positioned so that it is interrogated prior to the train entering said track section.

3. A proving circuit according to claim 1, wherein said transponder returns a message to the interrogator indicating a track condition as either an open or closed rail circuit.

4. A proving circuit according to claim 1, wherein said low resistance connection includes an electrical contact whose condition is used to control the message returned by the transponder to the interrogator.

5. A communication system according to claim 1, wherein the transponder is isolated from the rails of the track by a transformer.

6. A proving circuit according to claim 1, wherein the reflection of the impedance of the rail circuit back to the transponder is used to control the message of track condition returned by the transponder to the interrogator.

7. A communication system according to claim 1, wherein the input to the rail circuit is an alternating voltage, and wherein said low resistance connection between the rails includes a change-over contact whose condition is used to control the message returned by the transponder to the interrogator and a pair of parallel connected diode circuits connected in series with said change-over contact, each diode being connected to one pole of the change-over contact and the diode of one circuit being reversely connected with respect to the diode of the other circuit whereby the position of the change-over contact determines the polarity of the voltage in the rail circuit, said polarity being used to control the message returned by the transponder to the interrogator.

8. A communication system according to claim 7, wherein each diode is connected in series with a high inductive reactance.

9. A communication system according to claim 7, wherein the connection of the transponder to one rail of the track includes a pair of parallel connected track condition detectors which detect said polarity and control the output message of the transponder.

10. A proving circuit according to claim 1, and comprising at least two transponders physically positioned to be encountered in sequence by the train as the train moves along the track, the first transponder encountered being energized from the train to provide an input to voltage detection means which initiates operation of a track feature, this feature setting the condition of a relay contact in said rail circuit whereby to return a message of said condition to the interrogator on the train via a subsequent transponder encountered.

11. A communication system according to claim 1, wherein a direct current electrical power source is connected in said rail circuit to enhance the energization of the rail circuit from a passing train.

* * * * *